US009802736B2

(12) United States Patent
Fournier et al.

(10) Patent No.: US 9,802,736 B2
(45) Date of Patent: Oct. 31, 2017

(54) FASTENING DEVICE FOR SEALING A FLUID PRODUCT RESERVOIR

(71) Applicant: APTAR STELMI SAS, Villepinte (FR)

(72) Inventors: Ghislain Fournier, La Rochelle (FR); Mickaël Swal, Chauconin Neufmontiers (FR)

(73) Assignee: APTAR STELMI SAS, Villepinte (FR)

( * ) Notice: Subject to any disclaimer, the term of this patent is extended or adjusted under 35 U.S.C. 154(b) by 0 days.

(21) Appl. No.: 14/762,381

(22) PCT Filed: Feb. 11, 2014

(86) PCT No.: PCT/FR2014/050255
§ 371 (c)(1),
(2) Date: Jul. 21, 2015

(87) PCT Pub. No.: WO2014/125201
PCT Pub. Date: Aug. 21, 2014

(65) Prior Publication Data

US 2015/0360826 A1 Dec. 17, 2015

(30) Foreign Application Priority Data

Feb. 14, 2013 (FR) ..... 13 51270

(51) Int. Cl.
*B65D 51/02* (2006.01)
*B65D 41/16* (2006.01)
(Continued)

(52) U.S. Cl.
CPC ..... *B65D 41/16* (2013.01); *B05B 11/3049* (2013.01); *B65D 45/322* (2013.01); *B65D 51/002* (2013.01)

(58) Field of Classification Search
CPC .... B65D 41/16; B65D 45/322; B65D 51/002; B05B 11/3049
(Continued)

(56) References Cited

U.S. PATENT DOCUMENTS 5,819,964 A 10/1998 Grimard
2009/0283549 A1 11/2009 Beranger
2012/0160850 A1* 6/2012 Gelibert ..... B65D 55/063 220/320

FOREIGN PATENT DOCUMENTS

EP 0 006 032 A1 12/1979
EP 0 909 719 A1 4/1999
(Continued)

OTHER PUBLICATIONS

International Preliminary Report on Patentability dated Aug. 27, 2015 issued by the International Searching Authority in counterpart International Patent Application No. PCT/FR2014/050255.
(Continued)

*Primary Examiner* — James N Smalley
(74) *Attorney, Agent, or Firm* — Sughrue Mion, PLLC

(57) ABSTRACT

A fastener device for closing a fluid reservoir (1) formed with a neck (10) provided with outer peripheral reinforcement (11) that co-operates with the remainder of the neck to define a bottom shoulder (12). The device includes a fastener ring (2) for holding a closure member (4) on the neck (10), the fastener ring (2) including a peripheral skirt (21) engaged around the neck to below the bottom shoulder (12). The skirt (21) has fastener elements (26*a*, 26*b*) that form a contact zones (27*a*, 27*b*) suitable for potentially engaging the neck (10) below the bottom shoulder (12). The contact zones (27*a*, 27*b*) are situated at different axial heights, such that some contact zones (27*a*; 27*b*) come into operating
(Continued)

engagement below the bottom shoulder (12), while other contact zones (27*a;* 27*b*) remain inoperative.

16 Claims, 6 Drawing Sheets

(51) Int. Cl.
*B05B 11/00* (2006.01)
*B65D 45/32* (2006.01)
*B65D 51/00* (2006.01)

(58) Field of Classification Search
USPC ..... 215/247, 249, 277
See application file for complete search history.

(56) References Cited

FOREIGN PATENT DOCUMENTS

| | | | | |
|---|---|---|---|---|
| FR | 2 764 584 | A1 | 12/1998 | |
| FR | 2 884 806 | A1 | 10/2006 | |
| WO | 2005/000703 | A2 | 1/2005 | |
| WO | WO 2011032798 | A1 * | 3/2011 | ..... B65D 51/002 |

OTHER PUBLICATIONS

International Search Report for PCT/FR2014/050255 dated Jun. 11, 2014 [PCT/ISA/210].

* cited by examiner

FASTENING DEVICE FOR SEALING A FLUID PRODUCT RESERVOIR

CROSS REFERENCE TO RELATED APPLICATIONS

This application is a National Stage of International Application No. PCT/FR2014/050255 filed Feb. 11, 2014, claiming priority based on French Patent Application No. 1351270 filed Feb. 14, 2013, the contents of all of which are incorporated herein by reference in their entirety.

The present invention relates to a fastener device for closing, in leaktight manner, a fluid reservoir that may be in the form of a bottle, a carpule, a pre-filled syringe, a cartridge, etc. The reservoir forms a neck that is provided with outer peripheral reinforcement that co-operates with the remainder of the neck to define a bottom shoulder below which the fastener device catches. The advantageous field of application of the present invention is the field of reservoirs that are closed by means of a closure member that is perforable by means of a needle. However, the present invention may also apply to other fields such as the fields of pharmacy, perfumery, and cosmetics, in which the closure member is associated with a pump or a valve.

In the prior art, document FR 2 764 584 is known that describes a fastener device for fastening a pump or a valve on the neck of a reservoir. The fastener device comprises a fastener ring including a peripheral skirt that is engaged axially around the neck to below its shoulder. The skirt is provided with flaps having free ends that point inwards and upwards so as to come into abutment against the shoulder and thus snap-fasten the fastener ring on the neck of the reservoir. The fastener ring may be made of metal or of an injection-molded plastics material. In order to guarantee sealing at the neck, an O-ring is flattened by the fastener ring against the top edge of the neck. Even if it can be assumed that the fastener ring of that document is made with tolerances that are small or negligible, the snap-fastening of the flaps below the shoulder of the neck still depends on the thickness of the neck gasket, on its compressibility, and on the height of the peripheral reinforcement having manufacturing tolerances that may be considerable, particularly for a reservoir made of glass. In view of these variable parameters, it is not guaranteed that the flaps can pass under the shoulder of the neck, or that they can come into contact with the shoulder with a force that is sufficient to seal the neck gasket. As a result, the fastener ring of document FR 2 764 584 cannot guarantee that the pump or the valve is fastened in stable and leaktight manner on the neck of the reservoir. Document EP 0 006 032 describes a fastener device of the same type for closing a bottle containing a lyophilized material. The problems encountered with the fastener ring of that document are very close to the problems of above-mentioned document FR 2 764 584.

An object of the present invention is to remedy the above-mentioned drawbacks of the prior art by defining a fastener device that can come into engagement below the shoulder of the neck so as to guarantee fastening and good sealing, without depending on the thickness and the compressibility of the closure member and on the manufacturing tolerance of the neck. Another object of the present invention is to perform fastening below the shoulder of the neck, with the closure member being compressed appropriately.

To achieve these objects, the present invention proposes a fastener device for closing a fluid reservoir that is formed with a neck that is provided with outer peripheral reinforcement that co-operates with the remainder of the neck to define a bottom shoulder, said fastener device comprising a fastener ring for holding a closure member on the neck, the fastener ring including a peripheral skirt that is engaged axially around the neck to below the bottom shoulder, said skirt being provided with fastener elements that each form a contact zone that is suitable for potentially coming into bearing engagement with the neck below the bottom shoulder, so as to fasten the ring on the neck, the fastener device being characterized in that the contact zones are situated at different axial heights on the inner periphery of the skirt without axially overlapping, such that some contact zones come into operating engagement below the bottom shoulder, while other contact zones never come into operating engagement below the bottom shoulder of the neck, or vice versa.

In the above-mentioned prior art, all of the free ends of the flaps that form contact zones extend at the same level or at the same axial height, such that there is only a single snap-fastening position. The present invention has solved that problem by having contact zones at different levels or axial heights, so that at least some contact zones can be received below the shoulder with acceptable bearing force, while the other contact zones either remain around the peripheral reinforcement, or else are situated below the shoulder at a distance therefrom. There are as many fastening positions as there are different axial heights for the contact zones. By having the contact zones at different axial heights, fastening and acceptable sealing are guaranteed whatever the tolerances of the closure member in terms of dimension and compression, and whatever the manufacturing tolerances of the neck of the reservoir. It is even possible to use closure members that present dimensional and compression characteristics that are clearly different. Spreading the contact zones over a certain axial height multiplies the possibilities for fastening below the shoulder, whereas there is only a single possibility for fastening in the above-mentioned prior-art documents.

In an advantageous embodiment, the fastener elements are radially movable, so as to pass over the outer reinforcement of the neck and come into engagement below the bottom shoulder. Preferably, the fastener elements are stressed into a deformed position while passing over the outer peripheral reinforcement of the neck.

In another advantageous aspect, the contact zones define two distinct axial heights. In this way, the contact zones of each level are of sufficient size to guarantee robust fastening on the neck of the reservoir. It is clear that increasing the number of heights or levels for the contact zones necessarily implies a reduction in the size of the contact zones below the shoulder of the neck.

Advantageously, the closure member is axially deformable. This is useful when the closure member that closes the opening of the neck is in the form of a disk or a pellet made of elastomer. This is also useful when the closure member is in the form of a pump or a valve fitted with a neck gasket made of elastomer.

Preferably, the fastener ring is made of plastics material. However, it is equally possible to make the fastener ring out of metal.

According to another advantageous characteristic of the invention, the fastener device further comprises a blocking hoop that is engaged around the peripheral skirt in a final mounted position, so as to block at least some of the fastener elements below the bottom shoulder. Naturally, when the fastener elements suffice to fasten the ring on the neck, the blocking hoop is not functionally necessary. However, it may nevertheless be used, merely for reasons of appearance, so as to mask the fastener ring. Advantageously, the blocking hoop is held temporarily on the fastener ring in a pre-mounted position. Thus, the fastener ring and the blocking hoop co-operate with each other to constitute a solid unit that can be handled easily while mounting on a reservoir neck.

In a first practical embodiment of the invention, the fastener elements comprise tabs that extend freely downwards, the tabs forming inwardly- and upwardly-directed rims that define contact zones of different axial heights. Advantageously, the fastener device further comprises a blocking hoop that forms a blocking collar that is engaged around the tabs in a final mounted position, so as to block at least some of the tabs below the bottom shoulder, the blocking collar advantageously being elastically deformable. According to an advantageous characteristic, the peripheral skirt forms vertical blades that are separated by axial slots, the blocking hoop forming a plurality of vertical branches that are arranged in the axial slots between two vertical blades, in the final mounted position. In this way, the vertical branches of the blocking hoop are nested in the skirt of the fastener ring without creating any extra radial thickness. Specifically, the vertical branches may present a configuration and a wall thickness that are identical to the vertical blades of the peripheral skirt, such that the vertical branches of the hoop finish off the peripheral skirt. The radial wall thickness of the fastener device is thus limited to the radial thickness of the skirt.

In a second practical embodiment of the invention, the fastener elements comprise flaps having free ends that point inwards and upwards, the free ends forming the contact zones, some of which come into engagement below the shoulder, so as to fasten the fastener ring on the neck of the reservoir. The flaps are similar to the flaps in documents FR 2 764 584 and EP 0 006 032, except that their contact zones are at different axial heights. Advantageously, the flaps comprise at least two short flaps and at least two long flaps that define contact zones having two distinct axial heights, the short flaps being blocked below the shoulder by a blocking hoop that is engaged around the peripheral skirt. Preferably, each of the short flaps forms a base remote from its free end, which base projects radially outwards further than the bases of the long flaps, so as to come into engagement with the blocking hoop. Given that the short flaps are certain to be arranged below the shoulder of the neck, even if it is the long flaps that are in engagement with the shoulder of the neck, they guarantee that the fastener device cannot be dismantled, given that they are blocked below the shoulder by the blocking hoop. Thus, even if an ill-intentioned user succeeds in removing the long flaps from below the shoulder, the short flaps would come into abutment against the shoulder and, as a result of them being blocked by the blocking hoop, the fastener device could not be removed from the reservoir.

The present invention also defines a fluid reservoir including a neck that is provided with a fastener device as defined above, for holding a closure member in leaktight manner on the neck.

The spirit of the present invention resides in providing contact or fastener zones of the fastener ring at different or differentiated distinct levels or heights, so that at least some of the contact zones can come into engagement below the shoulder of the neck without having to worry about dimensional, dynamic, compression, or manufacturing tolerances of the component elements. Making the fastener device out of plastics material, which by definition presents a certain ability to deform elastically or plastically, makes it possible to impart even greater flexibility in use. Specifically, a little deformation or creep of the fastener elements at their contact zones can be envisaged.

The invention is described more fully below with reference to the accompanying drawings which show two embodiments of the invention by way of non-limiting example.

Figure 1:
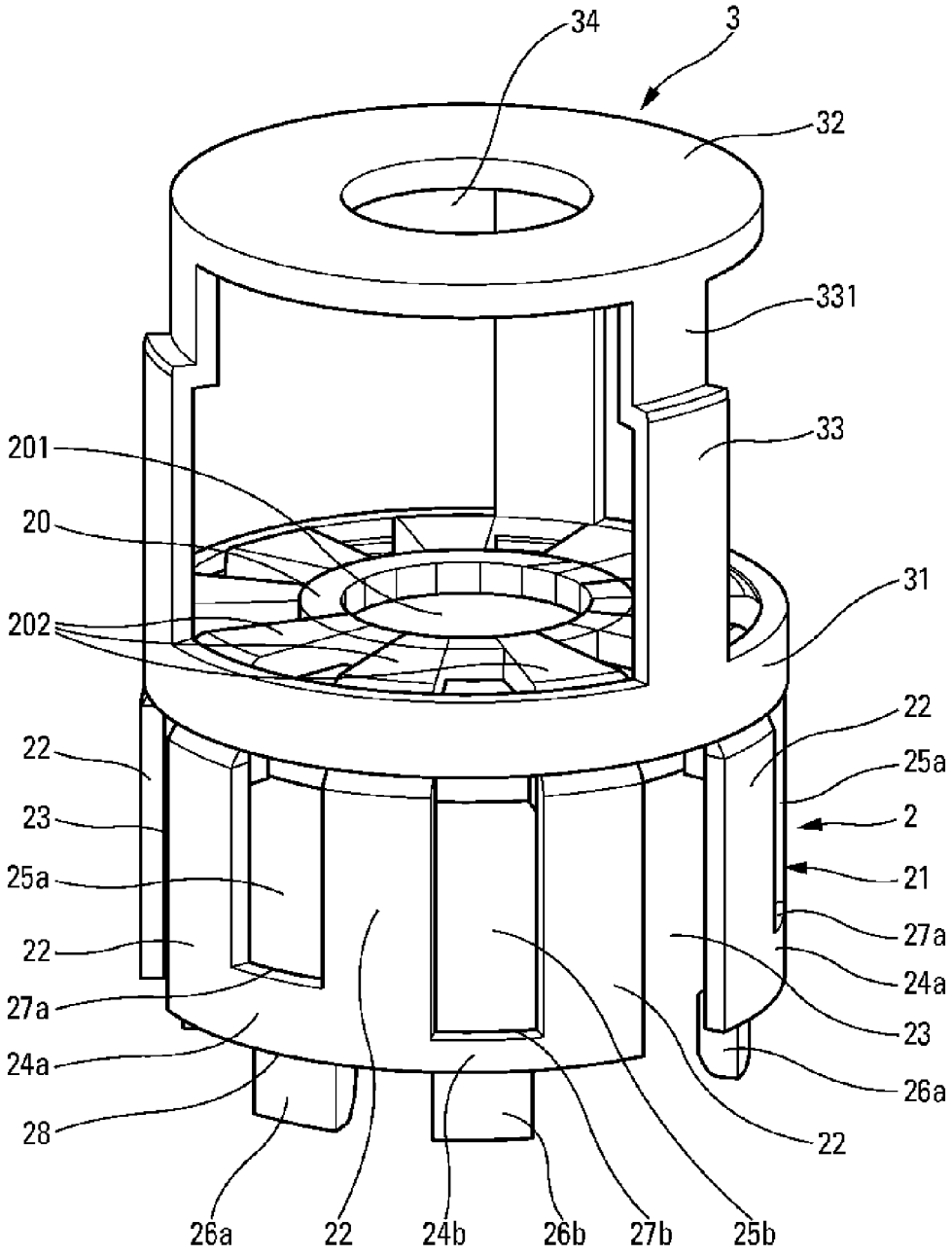
FIG. 1 is a much larger-scale perspective view of a fastener device in a first embodiment of the invention.
Figure 2:
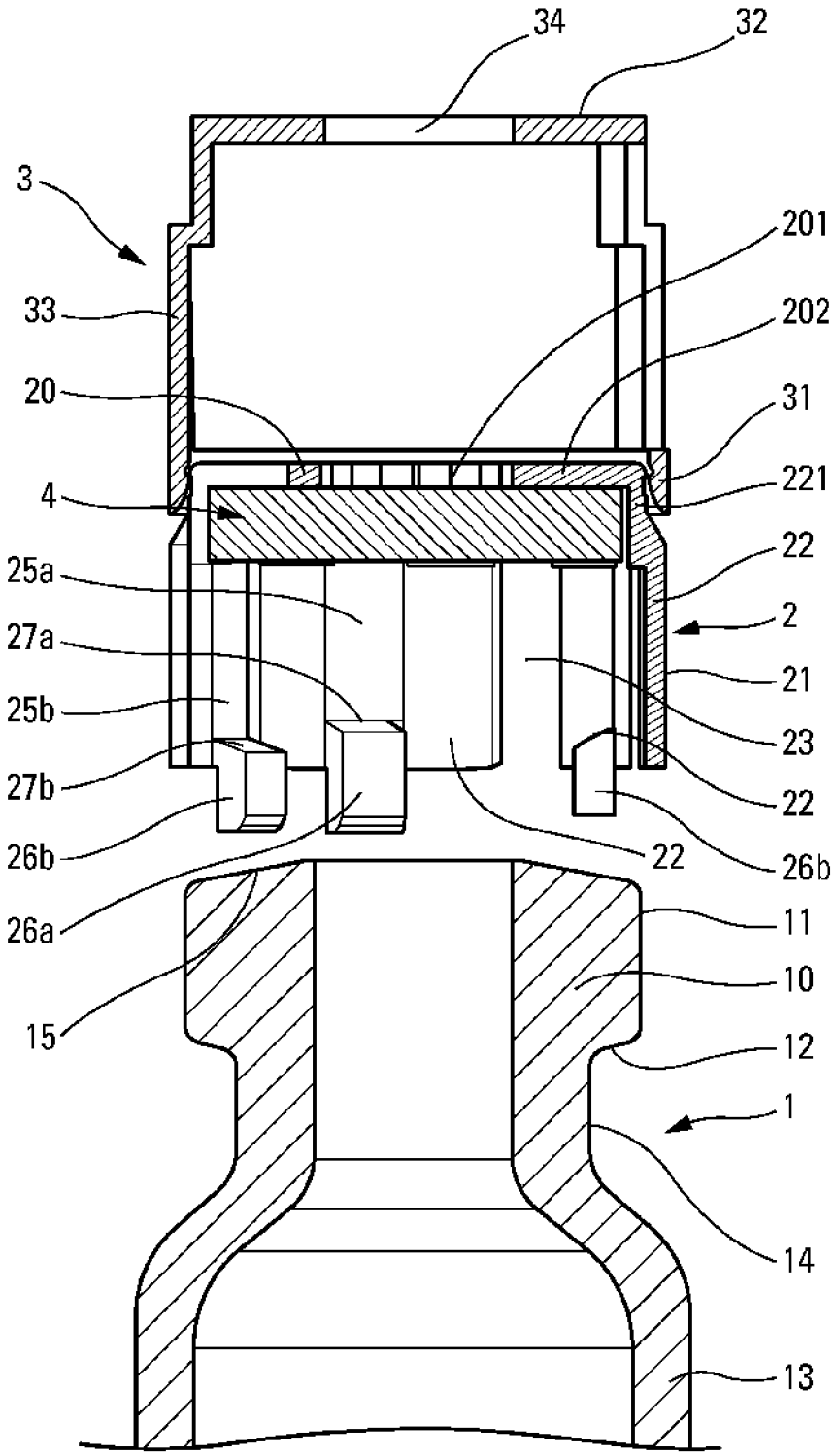
FIG. 2 is a section view through the FIG. 1 fastener device, ready to be mounted on a reservoir neck.
Figure 3B:
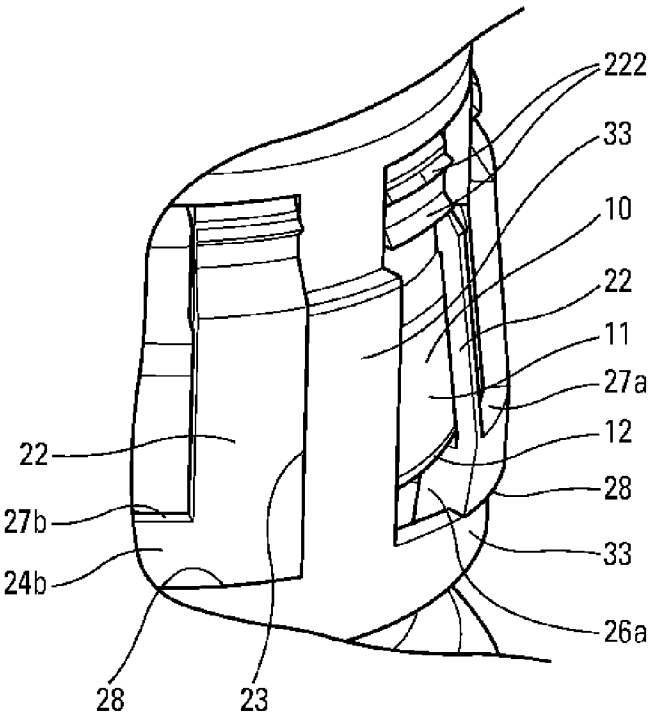
Figure 3A:
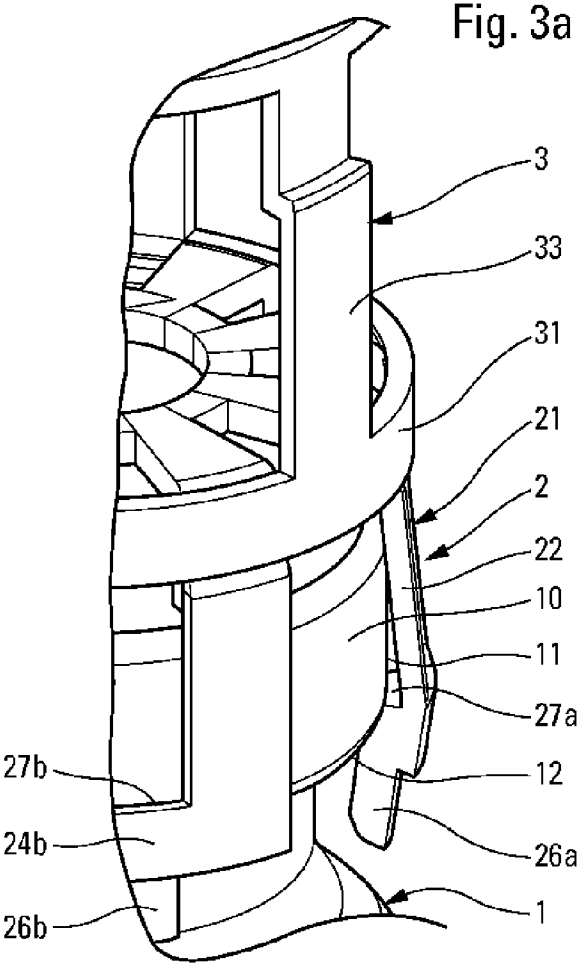
Figure 4:
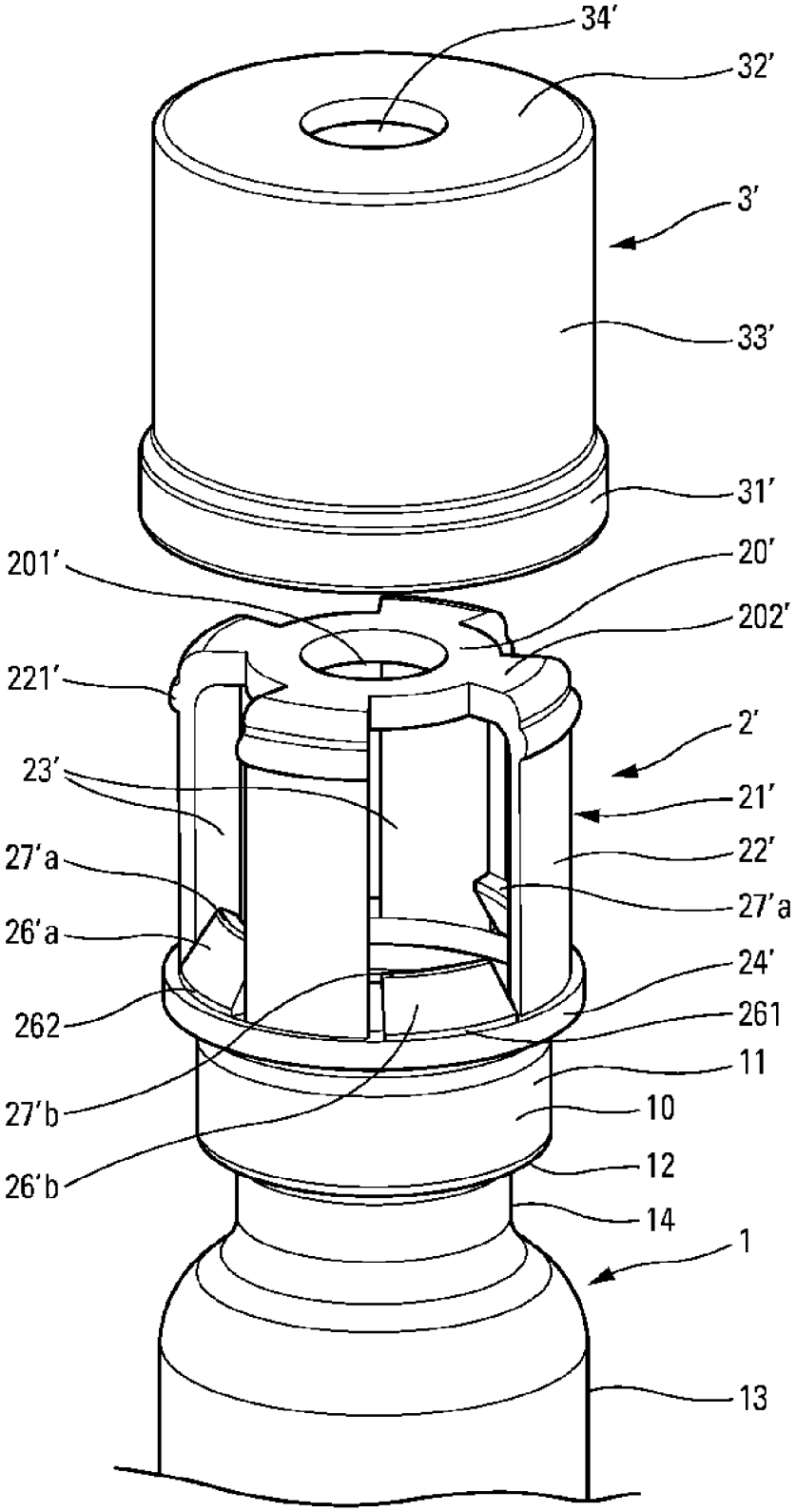
Figure 5:
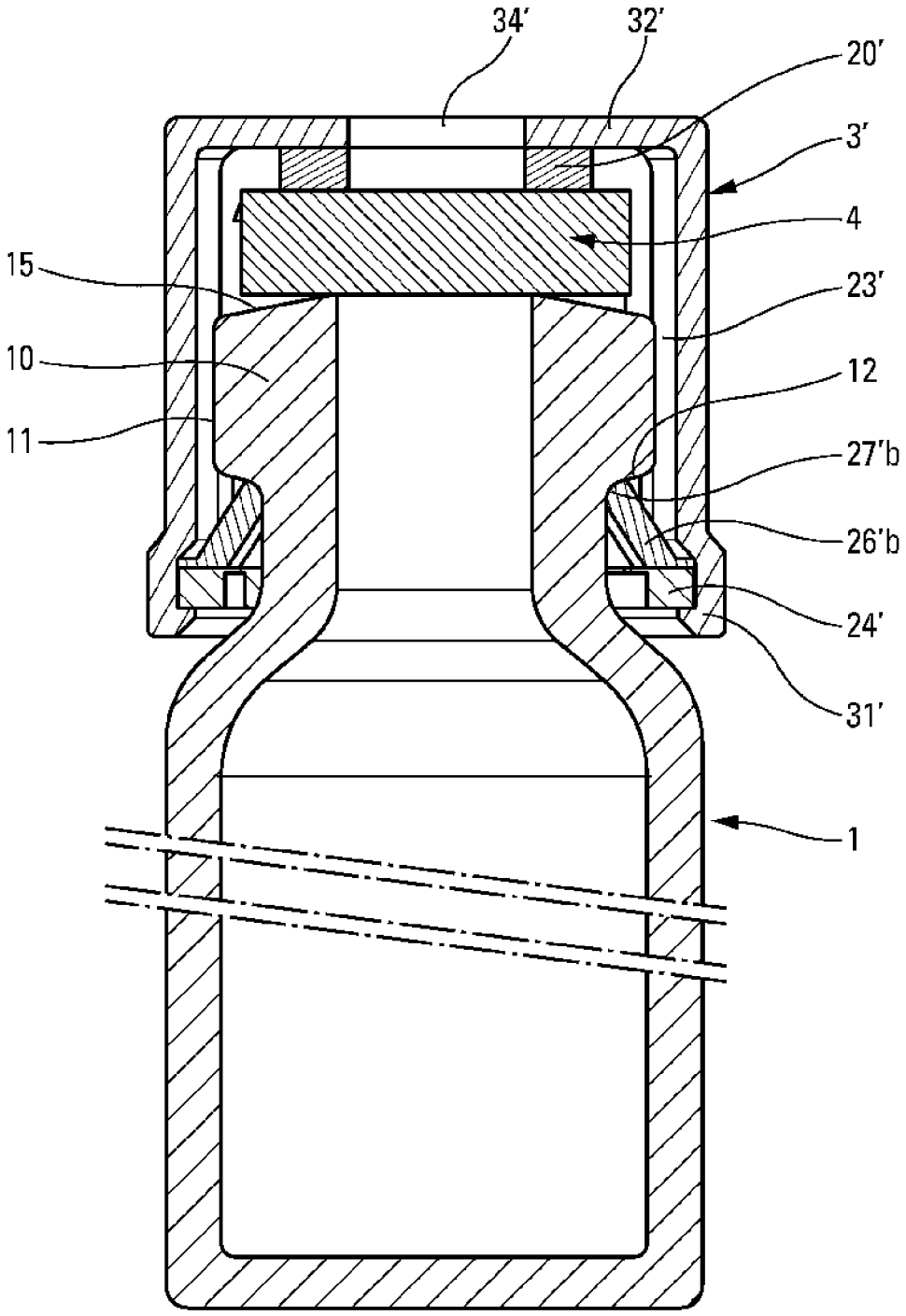
Figure 7:
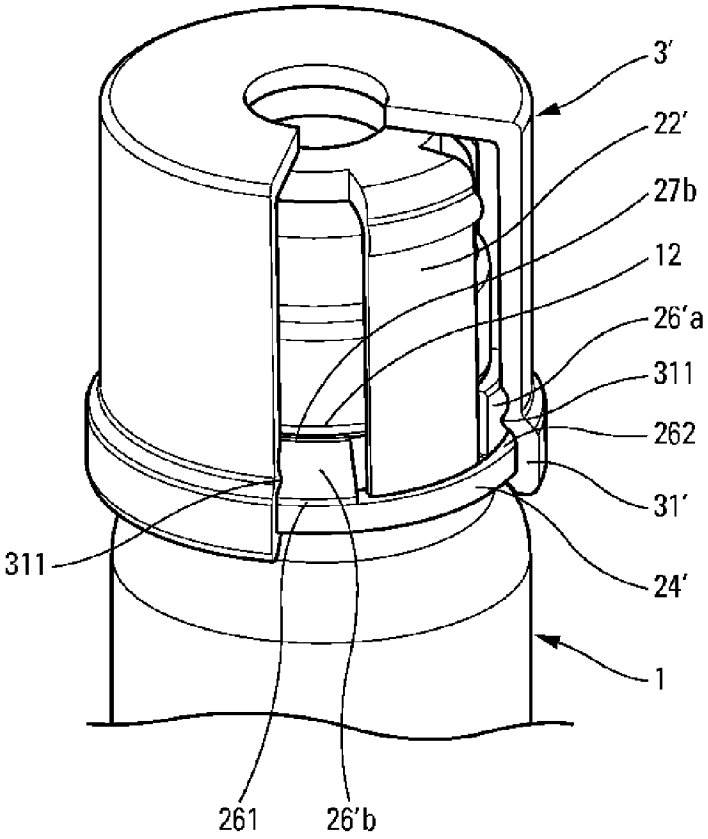
Figure 6:
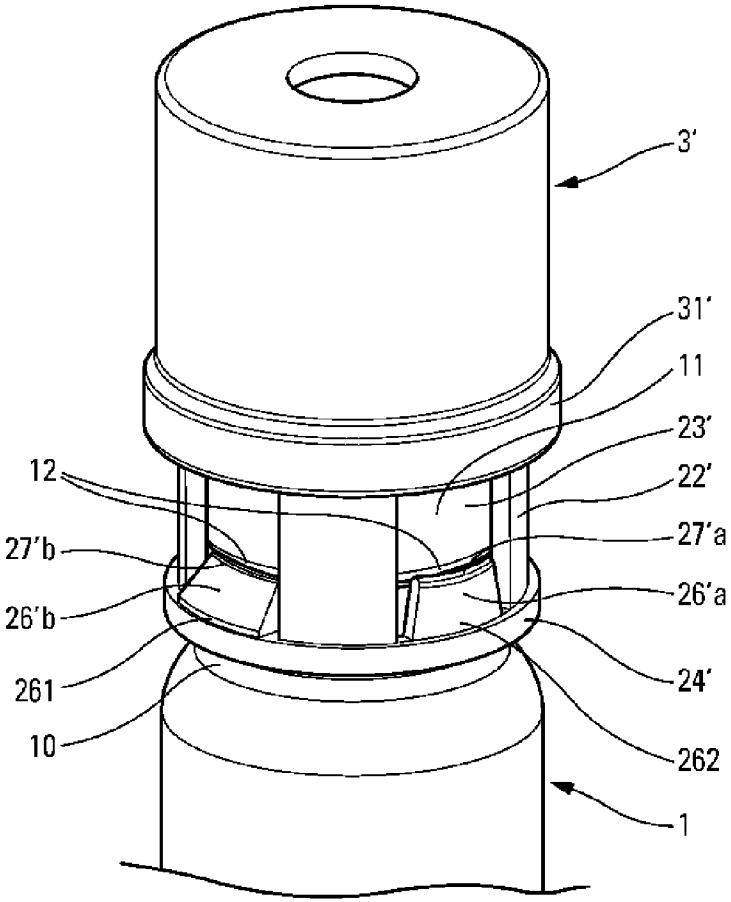

FIGS. 3*a* and 3*b* are fragmentary perspective views of the fastener device in FIGS. 1 and 2 during mounting on a reservoir neck;

FIG. 4 is a perspective view of a fastener device in a second embodiment of the invention, ready to be mounted on a reservoir neck;

FIG. 5 is a section view of the FIG. 4 fastener device in its final mounted position on a reservoir neck; and FIGS. 6 and 7 are perspective views of the fastener device in FIGS. 4 and 5 during mounting on a reservoir neck.

Reference is made firstly to FIGS. 1 and 2 in order to describe the structure of a device in the first embodiment of the invention. The fastener device comprises a fastener ring 2 and a blocking hoop 3 for mounting on a reservoir 1 in order to hold a closure member 4. The blocking hoop 3 may be an optional element in some applications.

The reservoir 1, that may be made of plastics material or of glass, is formed with a body 13 that is used to contain fluid, and a neck 10 at its top portion. It can be seen that the neck 10 extends from the body 13 with a cylindrical section 14, then forms an outwardly-directed shoulder 12, and is terminated by another cylindrical section of greater diameter, forming outer peripheral reinforcement 11. The shoulder 12 thus forms the transition between the reinforcement 11 and the remainder of the neck that forms the junction with the body 1. The neck also defines an annular edge 15. The reservoir may be in the form of a bottle, a carpule, a pre-filled syringe, a cartridge, etc. The bottom wall of the reservoir is permanent or removable.

In the embodiment shown, the closure member 4 is a disk or a pellet made of elastically-deformable material, e.g. rubber or any other elastomer material. Its thickness is about 0.5 millimeters (mm) to 30 mm, and its hardness on the shore A scale lies in the range 30 to 70. The closure member 4 is flattened against the annular edge 15 of the neck 10 with a force that makes it possible to reduce its thickness down to 40%. Although not shown, the closure member could equally well be in the form of a removable or permanent stopper, or in the form of a neck gasket that is associated with a dispenser member, such as a pump or a valve.

The fastener ring 2 is preferably made by injection-molding appropriate plastics material, e.g. polyethylene or polypropylene. The fastener ring 2 includes a top plate that is substantially plane and that includes a central collar 20 that internally defines an opening 201. The top plate also includes radial flanges 202 that extend outwards from the central collar 20 like spokes. The flanges 202 are spaced apart from one another and they are connected, at their outer periphery, to axial vertical blades 22 that are separated from one another either by axial slots 23 or by axial windows 25*a*, 25*b*. Fastener elements in the form of tabs 26*a*, 26*b* extend downwards from spacers 24*a*, 24*b* that interconnect certain blades 22. The blades 22, the spacers 24*a*, 24*b*, and the tabs 26*a*, 26*b* co-operate with one another to form a peripheral skirt 21 that is both slotted at the slots 23 and perforated at the windows 25*a*, 25*b*. It should be observed that the vertical axial slots 23 are open at their two axial ends, given that the blades 22 that are adjacent to a slot 23 are interconnected only via the central collar 20. Conversely, the blades 22 that are adjacent to a window 25*b* are interconnected via the spacer 24*b*. The same applies for the blades 22 that are adjacent to the windows 25*a*: they are interconnected via the spacer 24*a*. In the non-limiting embodiment in FIGS. 1 to 3*b*, three blades 22 are interconnected via a spacer 24*a* and a spacer 24*b*, the end blades being adjacent to two axial slots 23.

It should be observed that the windows 25*a* are smaller than the windows 25*b*, given that the spacer 24*a* is axially taller than the spacer 24*b*. With reference to FIG. 2, it can be seen that the threshold of the windows forms the top rim of the tabs 26*a* and 26*b*. The rims form contact zones 27*a*, 27*b* for potentially coming into engagement below the shoulder 12 of the neck 10. Given that the spacers 24*a* and 24*b* present different heights, the contact zones 27*a* and 27*b* are also situated at different levels or heights, as can be seen clearly in FIG. 2. It can clearly be seen that the tab 26*a* is taller than the tab 26*b*, such that the tab 26*a* may be described as a long tab and the tab 26*b* as a short tab. In other words, the distance between the contact zone 27*a* and the closure member 4 is shorter than the distance between the contact zone 27*b* and the closure member 4. It should be observed that each tab 26*a*, 26*b* defines only a single contact zone 27*a*, 27*b*, such that the contact zones are distributed over the inner periphery of the skirt 21 without ever overlapping axially. It should also be observed that the tabs 26*a*, 26*b* extend inside the spacers 24*a*, 24*b*, such that they are set back from a bottom edge 28 formed conjointly by the blades 22 and the spacers 24*a*, 24*b*, as can be seen in FIG. 1.

The blades 22, in the proximity of their junctions with the flanges 202, form re-entrant risers 221 that may be provided with retainer profiles 222, shown in FIG. 3*b*.

The closure member 4 is arranged or pre-mounted inside the fastener ring 2, in contact with the top plate formed by the central collar 20 and its flanges 202. The peripheral edge of the closure member 4 may be engaged inside the re-entrant riser 221 formed by the blades 22. The closure member 4 is accessible from the outside through the opening 201.

The blocking hoop 3 includes a top disk 32 that defines a central passage 34 that is in alignment with the opening 201 of the ring 2. On its outer periphery, the disk 32 is provided with a plurality of vertical axial branches 33 that preferably present a profile that is comparable with, or identical to, the profile of the blades 22. By way of example, it should be observed that each branch 33 forms a re-entrant riser 331, like the riser 221 of the blades 22. The branches 33 are interconnected at their bottom ends via a blocking collar 31 that is preferably continuous over its entire periphery. The blocking hoop 3 may be made of a material that is relatively flexible or elastically deformable, such as polyethylene or polypropylene.

As can be seen in FIG. 1, the blocking hoop 3 may be mounted in temporary and non-permanent manner on the fastener ring 2 by engaging the blocking collar 31 around the re-entrant riser 221 of the blades 22 that are advantageously provided with retainer profiles 222. The blocking collar 31 may advantageously be made with corresponding profiles on its inside face so as to co-operate with the retainer profiles 222 of the re-entrant risers. In this pre-mounted temporary configuration, the blocking hoop 3 and the fastener ring 2 co-operate with each other to form a solid unit that is difficult to dismantle. This solid unit may be handled easily, in particular while mounting the fastener ring on a reservoir neck. It should be observed that the blocking hoop 3 may advantageously be oriented on the fastener ring 2 in such a manner as to position the vertical branches 33 above and in register with the vertical axial slots 23. To do this, it may be provided with orientation or indexer means that make it possible to position the hoop 3 angularly on the ring 2 in the position shown in FIG. 1.

With reference to FIG. 3*a*, it can be seen that the peripheral skirt 21 is engaged around the neck 10 of the reservoir 1. The blocking hoop 3 is still in its pre-mounted temporary position. It should be observed that the contact zone 27*a* of the long tab 26*a* does not manage to be received below the shoulder 12 of the neck 10, whereas the contact zone 27*b* of the short tab 26*b* is engaged below the shoulder 12. In this application, the height of the peripheral reinforcement 11, and the thickness of the closure element 4 or its compressibility do not enable the long tabs to be engaged below the shoulder 12. With peripheral reinforcement 11 of smaller height, and/or a thinner or more flexible closure member, the long tabs 26*a* could engage below the shoulder 12, but, in this configuration, the contact zones 27*b* would then no longer be in contact with the shoulder 12. In FIG. 3*a*, the blade 22 that is adjacent to the long tab 26*a* is deformed outwards a little, and is constrained to remain in this state.

Axial thrust on the disk 32 of the blocking hoop 3 enables the blocking collar 31 to leave its pre-mounted temporary position and to slide with friction around the blades 22, so as to reach the final mounted position in which it comes to be received below the blades 22 and the spacers 24*a*, 24*b*, in contact with the outside face of the tabs 26*a*, 26*b*. The blocking collar 31 blocks the short tabs 26*b* below the shoulder 22 and stresses the long tabs 26*a* very strongly against the peripheral reinforcement 11. This is shown in FIG. 3*b*, in which it can be seen that the collar 33 is deformed outwards a little at the long tab 26*a* that cannot engage below the shoulder 12, or that can engage in part only. The blade 22 that is adjacent to the long tab 26*a* still slopes outwards a little. It should be observed that the blade 22 that is both adjacent to the long tab 26*a* and to the branch 33 has been cut away in part in FIG. 3*b* so as to show the incomplete engagement of the long tab 26*a* below the shoulder 12.

According to a characteristic of the invention, the vertical branches 33 of the blocking hoop 3 are arranged in the axial vertical slots 23 in such a manner as to fill them. As a result, the branches 33 finish off the peripheral skirt 21 in the slots 23. It should also be observed that the blocking collar 31 comes into alignment with the outer wall of the blades and is touching the bottom edge 28. Only the windows 25*a*, 25*b* remain open. By making the branches 23 with a wall thickness that is equal to, or less than, the wall thickness of the blades 22, they are completely nested in the windows without creating any extra radial thickness, either inwards or outwards. A fastener device is thus obtained having radial thickness around the neck that is limited to the thickness of the peripheral skirt 21. Furthermore, the branches 33 and the collar 31 consolidate the ring 2.

In the second embodiment in FIGS. 4 to 7, the fastener ring 2' includes a central collar 20' that defines an opening 201'. From the collar 20', four flanges 202' extend radially outwards, which flanges are extended downwards by four axial vertical blades 22' that connect a bottom band 24'. In this embodiment, the skirt 21' is formed by the four blades 22' and the band 24'. The blades 22' are separated by slots 23' that extend from the collar 20' to the band 24': the slots 23' are thus axially open at their top ends. Between each pair of blades 22', the band 24' forms a flap 26*a*', 26*b*' that points upwards and inwards in a respective slot 23'. The free ends of the flaps form contact zones 27*a*', 27*b*' that are suitable for coming into bearing contact against the shoulder 12 of the neck. Two of the flaps 26*a*' are long and the other two flaps 26*b*' are short, such that the contact zones 27*a*' of the flaps 26*a*' are axially higher than the contact zones 27*b*' of the flaps 26*b*'. In other words, the axial heights of the contact zones 27*a*' and 27*b*' are different or distinct. It should also be observed that the thickness of the flaps is advantageously equal to, or less than, the wall thickness of the band 24', so that the flaps can be received in the slots 23' without projecting either inwards or outwards. The flaps can thus be contained entirely within their respective slots. Preferably, the flaps are formed originally so as to be directed inwards, since this makes it possible to avoid a subsequent operation of folding the flaps inwards below the shoulder 12 of the neck. The flaps and, as a result, the ring itself, are preferably molded out of plastics material in the state shown in FIG. 4. It should also be observed that the base 261 of the short flaps 26*b*' is flush with the outer edge of the band 24', while the base 262 of the long flaps 26*a*' is situated set back from the outer edge of the band 24', for reasons that are given below. In the proximity of their top ends, the blades 22' externally form respective snap-fastener beads 221' for co-operating with the blocking hoop 3' in the pre-mounted temporary position.

The closure member 4 is housed below the collar 20' and the flanges 202', between the blades 22'. The closure member may be identical or similar to the closure member of the first embodiment.

The blocking hoop 3' includes a top disk 32' that defines a central passage 34' that is in alignment with the opening 201', as can be seen in FIG. 5. A substantially-cylindrical casing 33' extends downwards from the outer periphery of the disk 20'. At its bottom end, the casing 33' forms a blocking collar 31' that internally forms a snap-fastener housing.

In a pre-mounted temporary position shown in FIG. 6, the collar 31' is in engagement with the snap-fastener beads 221' of the blades 22', in such a manner as to constitute a solid unit that can be handled easily, in particular while mounting on the neck 10. The band 24' is axially engaged around the reinforcement 11 of the neck until the short flaps 26*b*' are received below the shoulder 12 of the neck. Then, an additional bearing force on the hoop 3' makes it possible to verify whether it is possible to cause the band 24' to descend until the long flaps 26*a*' are also received below the shoulder 12. If this is not possible as a result of the thickness and/or the compression of the closure member and/or as a result of the manufacturing tolerance of the neck, the ring 2' is fastened by the short flaps 26*b*' having their contact zones 27*b*' in bearing contact against the shoulder 12. The long flaps 26*a*' thus remain engaged around the reinforcement 11, as can be seen in FIG. 6. However, they are received entirely in their respective windows 23', especially since their bases 262 are set back from the outer edge of the band 24'. A sufficient force on the hoop 3' enables it to descend around the skirt 21' from the pre-mounted position in FIG. 6, so as to reach the final mounted position in FIG. 7. The collar 31' is then in snap-fastening engagement around the band 24'. Advantageously, just above the collar 31', the hoop 3' forms a rib 311 that bears against the short flaps 26*b*' so as to block them below the shoulder 12, but it does not bear against the long flaps 26*a*', as a result of their bases 262 being situated set back. Thus, when the long flaps 26*a*' are disengaged from below the shoulder 12, the fastener device is nevertheless fastened by short flaps 26*b*' that are blocked by the rib 311 of the hoop 3'.

Although FIGS. 1 to 7 show rings that present contact zones that define two different axial heights, it is possible to envisage a ring with more contact zones of different heights. However, two different axial heights make it possible to cover a relatively wide range of tolerances, while preserving sufficient firmness and sealing. Some contact zones 27*a*, 27*a*' come into operating engagement below the bottom shoulder 12, while other contact zones 27*b*, 27*b*' never come into operating engagement below the bottom shoulder 12 of the neck 10, or vice versa. The contact zones that remain inoperative are either situated below the shoulder 12, without touching it, or at the reinforcement 11 without ever passing below the shoulder 12.

By means of the invention, a fastener ring is obtained that may be made in standard manner, that may be associated with closure members of various kinds, and that may be mounted on reservoirs having neck tolerances that are relatively large. The tabs 26*a*, 26*b* and the re-entrant flaps 26*a*', 26*b*' constitute only two particular non-limiting embodiments: specifically, it is possible to perform the present invention with any type of fastener element that is suitable for coming into engagement with a bottom shoulder formed by the neck of a reservoir.

By means of the invention, the space occupied by the fastener device is greatly reduced, given that the blocking hoop 3 does not create extra thickness at the peripheral skirt of the fastener ring.

The invention claimed is:

1. A fluid reservoir comprising:

a neck provided with outer peripheral reinforcement that co-operates with a remainder of the neck to define a bottom shoulder;

a closure member; and a fastener device for closing the fluid reservoir, said fastener device comprising a fastener ring that holds the closure member on the neck, the fastener ring including a peripheral skirt that is engaged axially around the neck to below the bottom shoulder, said skirt being provided with fastener elements that each form a contact zone;

wherein the contact zones are situated at different axial heights on the inner periphery of the skirt without axially overlapping, such that some contact zones come into operating engagement below the bottom shoulder, while other contact zones never come into operating engagement below the bottom shoulder of the neck; and wherein the contact zones in engagement with the neck below the bottom shoulder fasten the ring on the neck.

2. The fluid reservoir according to claim 1, wherein the fastener elements are radially movable, so as to pass over the outer reinforcement of the neck.

3. The fluid reservoir according to claim 1, wherein the contact zones define two distinct axial heights.

4. The fluid reservoir according to claim 1, wherein the closure member is axially deformable.

5. The fluid reservoir according to claim 1, wherein the fastener ring is made of plastics material.

6. The fluid reservoir according to claim 1, further comprising a blocking hoop that is engaged around the peripheral skirt in a final mounted position, so as to block at least some of the fastener elements below the bottom shoulder.

7. The fluid reservoir according to claim 6, wherein the blocking hoop is held temporarily on the fastener ring in a pre-mounted position.

8. The fluid reservoir according to claim 1, wherein the fastener elements comprise tabs that extend freely downwards, the tabs forming inwardly- and upwardly-directed rims that define contact zones of different axial heights, each tab forming a single contact zone.

9. The fluid reservoir according to claim 8, further comprising a blocking hoop that forms a blocking collar that is engaged around the tabs in a final mounted position, so as to block at least some of the tabs below the bottom shoulder, the blocking collar being elastically deformable.

10. The fluid reservoir according to claim 9, wherein the peripheral skirt forms vertical blades that are separated by axial slots, the blocking hoop forming a plurality of vertical branches that are arranged in the axial slots between two vertical blades, in the final mounted position.

11. The fluid reservoir according to claim 1, wherein the fastener elements comprise flaps having free ends that point inwards and upwards, the free ends forming the contact zones, some of which come into engagement below the shoulder, so as to fasten the fastener ring on the neck of the reservoir.

12. The fluid reservoir according to claim 11, wherein the flaps comprise at least two short flaps and at least two long flaps that define contact zones having two distinct axial heights, the short flaps being blocked below the shoulder by a blocking hoop that is engaged around the peripheral skirt.

13. The fluid reservoir according to claim 12, wherein each of the short flaps forms a base remote from its free end, which base projects radially outwards further than the bases of the long flaps, so as to come into engagement with the blocking hoop.

14. A fastener device for closing a fluid reservoir that is formed with a neck that is provided with outer peripheral reinforcement that co-operates with the remainder of the neck to define a bottom shoulder, the fastener device comprising a fastener ring configured to hold a closure member on the neck, the fastener ring including a peripheral skirt configured to engage axially around the neck to below the bottom shoulder, the skirt provided with fastener elements that each form a contact zone configured to bear against the neck with at least one coming into bearing engagement with the neck below the bottom shoulder, so as to fasten the ring on the neck;

wherein the contact zones are situated at different axial heights on the inner periphery of the skirt without axially overlapping, such that some contact zones come into operating engagement below the bottom shoulder, while other contact zones do not come into operating engagement below the bottom shoulder of the neck; and wherein each fastener element extends downwards from a proximal base of the fastener element attached to the skirt to a free distal edge of the fastener element.

15. The fastener device according to claim 14, wherein the distal end of each fastener element is at a same axial height relative to a central axis of the skirt axis.

16. The fastener device according to claim 14, wherein the distal end the fastener elements define a lowest axial portion of fastener.

* * * * *